US006805251B2

(12) United States Patent
Radewagen et al.

(10) Patent No.: US 6,805,251 B2
(45) Date of Patent: Oct. 19, 2004

(54) DEVICE FOR HORIZONTAL RESETTING TO CENTER FOR A CENTRAL BUFFER COUPLING ARRANGED PIVOTABLY BY MEANS OF A COUPLING SHAFT ON A RAIL-BORNE VEHICLE

(75) Inventors: Christian Radewagen, Salzgitter (GB); Antony Jones, Cheshire (GB)

(73) Assignee: Voith Turbo Scharfenberg GmbH & Co. KG, Salzgitter (DE)

( * ) Notice: Subject to any disclaimer, the term of this patent is extended or adjusted under 35 U.S.C. 154(b) by 73 days.

(21) Appl. No.: 10/322,931

(22) Filed: Dec. 18, 2002

(65) Prior Publication Data

US 2003/0116519 A1 Jun. 26, 2003

(30) Foreign Application Priority Data

Dec. 20, 2001 (DE) ..... P101 62 731

(51) Int. Cl.[7] ..... B61G 7/12
(52) U.S. Cl. ..... 213/20
(58) Field of Search ..... 213/4, 15, 18, 213/19, 20, 21

(56) References Cited

U.S. PATENT DOCUMENTS

| | | | | | |
|---|---|---|---|---|---|
| 3,445,005 | A | * | 5/1969 | Kulieke, Jr., et al. | 213/20 |
| 3,484,000 | A | * | 12/1969 | Cope | 213/20 |
| 3,498,475 | A | * | 3/1970 | Cope | 213/15 |
| 3,520,421 | A | | 7/1970 | Gutridge | |
| 3,587,870 | A | * | 6/1971 | Cope | 213/15 |
| 3,627,144 | A | | 12/1971 | Dwyer, Jr. et al. | |
| 3,788,493 | A | * | 1/1974 | Hawthorne et al. | 213/20 |
| 3,926,317 | A | * | 12/1975 | Scharfenberg et al. | 213/20 |
| 4,013,175 | A | * | 3/1977 | Klein et al. | 213/20 |
| 4,485,931 | A | * | 12/1984 | Forster et al. | 213/4 |
| 4,569,455 | A | * | 2/1986 | Bodiford, Jr. | 213/19 |
| 4,586,620 | A | * | 5/1986 | Andrews | 213/15 |
| 5,472,104 | A | * | 12/1995 | Domsgen | 213/4 |
| 5,687,860 | A | * | 11/1997 | Behrens et al. | 213/7 |

FOREIGN PATENT DOCUMENTS

| | | |
|---|---|---|
| DE | 18 10 593 B2 | 6/1970 |
| DE | 24 19 184 A1 | 11/1975 |
| DE | 24 45 460 | 4/1976 |
| DE | 28 22 104 A1 | 11/1979 |
| DE | 43 28 811 C1 | 10/1994 |
| DE | 195 26 504 C1 | 7/1996 |

* cited by examiner

*Primary Examiner*—S. Joseph Morano
*Assistant Examiner*—Lars Olson
(74) *Attorney, Agent, or Firm*—McGlew and Tuttle, P.C.

(57) ABSTRACT

A device (1) is provided for horizontal resetting to center for a central buffer coupling arranged pivotably by a coupling shaft (2) on a rail-borne vehicle. The device has a guide (3) following the pivoting movement of the coupling shaft (2) around its vertical pivot axis. The device has pressing surfaces (4) provided symmetrically to the longitudinal axis of the coupling shaft (2), and has a pressing device (7), with parts supported against an articulated housing (5) for the coupling shaft and bringing about the horizontal resetting to center. The pressing device acts permanently or switches off or can be switched off depending on the pivot angle or can be actuated by a pneumatically, hydraulically or electrically operated actuating device. To facilitate especially the coupling in tight curves or to make it possible in the first place, the actuating device is designed as a remote-controllable adjusting drive (11). The adjusting drive acts on the guide (3) and consequently the coupling shaft (2) that is functionally connected thereto to position the same into any position of the intended horizontal range of pivoting of the coupling shaft (2) in the flow of forces via the device (1) for resetting to center.

20 Claims, 2 Drawing Sheets

DEVICE FOR HORIZONTAL RESETTING TO CENTER FOR A CENTRAL BUFFER COUPLING ARRANGED PIVOTABLY BY MEANS OF A COUPLING SHAFT ON A RAIL-BORNE VEHICLE

FIELD OF THE INVENTION

The present invention pertains to a device for horizontal resetting to center for a central buffer coupling arranged pivotably by means of a coupling shaft on a rail-borne vehicle with a guide, which follows the pivoting movement of the coupling shaft around its vertical pivot axis, with pressing surfaces provided symmetrically to the longitudinal axis of the coupling shaft, and with a pressing means supported on an articulated housing for the coupling shaft and bring about the horizontal resetting to center, wherein one part of the pressing means acts permanently or can be switched off depending on the pivot angle or can be actuated by a pneumatically, hydraulically or electrically operated actuating means associated with each part of the pressing means.

BACKGROUND OF THE INVENTION

Such devices for resetting to center are known, e.g., from U.S. Pat. No. 3,926,317DE 18 10 593 B2, DE 24 19 184 A1, DE 28 22 104 A1 or U.S. Pat. No. 4,013,175 DE 24 45 460 A1.

DE 18 10 593 B2 shows a device for horizontal resetting to center for a central buffer coupling arranged pivotably by means of a coupling shaft on a rail-borne vehicle with a guide following the pivoting movement of the coupling shaft around its vertical pivot axis. Oblique pressing surfaces are arranged at the guides symmetrically to the longitudinal axis of the coupling shaft. Spring-loaded pressing means, which are supported on the housing for the coupling shaft and bring about horizontal resetting to center, have a resetting spring, a pressure transmitting member, which is acted on by the resetting spring, cooperates with the pressing surfaces and carries a roller, as well as a stop member limiting the movement of the pressure transmitting member, wherein a pressing means is associated with each pressing surface.

DE 24 19 184 A1 discloses another device for horizontal resetting to center of a central buffer coupling for rail-borne vehicles, in which a compression spring, which is in contact with a sliding block each guided in a housing, is arranged symmetrically on both sides of the coupling axis. Via an associated support roller with vertical axis, the sliding blocks are pressed by the force of the pretensioned compression springs against a guide that follows the horizontal pivoting movement of the coupling shaft around the vertical pivot axis of the central buffer coupling. The support rollers form a pair of support rollers each, which is mounted in the guide symmetrically on both sides of the coupling axis, and whose two support rollers have different distances from the coupling axis, wherein the axes of the support rollers are located on a circle that is concentric to the vertical pivot axis of the central buffer coupling. In the middle position of the central buffer coupling, the support rollers of each pair of support rollers are in contact with a sliding surface each of the sliding block, which has an approximately triangular top view, wherein a guide shaft, which passes through the housing and is guided in same, is arranged at each sliding block. The centering device acts during normal operation, i.e., even during travel in curves or over switches, so that the sliding surfaces of the sliding blocks, which are pressed by the compression springs against the support rollers, are subject to a relatively great wear due to the pivoting movement of the central buffer coupling. Coupling in a curve is possible only with difficulty only or not at all, because the resetting forces of the compression springs counteract the pivoting out of the central buffer couplings to be coupled, which is brought about manually.

However, DE 28 22 104 A1 discloses a means that eliminates the drawbacks of the above-mentioned device by the resetting to center being able to be switched off and if a resetting to center is not necessary or not desired, it is switched off. To achieve this, a two-armed pivoted lever each is articulated to the guide shafts of the sliding blocks, and one lever arm of the pivoted lever is directly or indirectly connected to a lifting cylinder, and the other lever arm of the pivoted lever is supported by the housing, and by pivoting the pivoted levers by means of actuated or remote-controllable lifting cylinders against the force of the compression springs, the sliding blocks can be brought into a position in which the support rollers have no contact with the sliding blocks during a horizontal pivoting movement of the coupling shaft and the coupling shaft can be consequently freely pivoted, not loaded by the compression spring.

DE 24 45 460 A1 discloses a device for the controllable resetting to center of central buffer couplings, in which a cam functionally connected to the drawbar extends between two stops, which are arranged displaceably by pneumatically, hydraulically or electrically acting actuating means in the horizontal path of the cam, wherein the full horizontal lateral deflection of the drawbar is available in one end position of the stops, whereas the cam is clamped between the stops and the drawbar is consequently fixed in the middle position in the other end position of the cams. It is achieved with this means that the drawbar remains fixed and extensively free from vibrations in the middle position during travel, but, on the other hand, this blocking of the middle position is not obtained at the expense of the application of excessive deflecting forces during normal operation.

DE 43 28 811 C1 discloses a central buffer coupling with horizontally pivotable, front-side coupling shaft, which carries the coupling head and can be pivoted together with same manually behind the front side of the rail-borne vehicle and locked after loosening a fixing means when not in use.

Furthermore, DE 195 26 504 C1 discloses a central buffer coupling for rail-borne vehicles, which has a rear articulated arm articulated to and supported on the vehicle as well as a front articulated arm articulated thereto via a center-pivot hinge with a vertical hinge pin, which front articulated arm carries the coupling head. A locking part connected to the articulated arms is designed as a rotatably mounted locking bolt, which is connected kinematically to a drive supported on the rear articulated arm. The drive has a drive element freely movable between stops for pivoting the front articulated arm. The front articulated arm can thus be pivoted in and out with the coupling head by a motor and can be brought behind the front-side limitation of the vehicle when not in use to reduce the hazard potential.

SUMMARY OF THE INVENTION

The basic object of the present invention is to improve a device for horizontal resetting to center of the type described in the introduction such that coupling in curves is facilitated or made possible in the first place.

According to the invention, a device is provided for horizontal resetting to center for a central buffer coupling arranged pivotably using a coupling shaft on a rail-borne vehicle. A guide is provided that follows the pivoting movement of the coupling shaft around its vertical pivot axis. Pressing surfaces are provided symmetrically to the longitudinal axis of the coupling shaft. A pressing means is provided with parts supported on an articulated housing for the coupling shaft. The pressing parts bring about the horizontal resetting to center. One of the pressing parts acts permanently or can be switched off depending on the pivot angle or can be actuated by a pneumatically, hydraulically or electrically operated actuating means associated with each pressing part of the pressing means. The actuating means is designed as a remote-controllable adjusting drive. The guide and consequently the coupling shaft, that is in functional connection therewith, can be positioned via the device for resetting to center or into any position of the intended horizontal range of pivoting of the coupling shaft in the flow of forces by means of the adjusting drive.

The state of the art is improved by the features of the invention especially by the fact that it is now possible to make automated coupling possible in tight curves. Even though prior-art devices are able to make possible in an automated or remote-controlled manner the resetting to center or fixation of the drawbar in the middle position or even switching off and consequently a load-free, manual pivoting of the coupling shaft, the use of personnel continues to be necessary for highly risky operations in the area of the coupling. However, automated or remote-controlled, accurate positioning of the drawbar and consequently of the coupling head according to the situation needs into any angular position of the intended horizontal range of pivoting in curves, especially in tight curves, is not possible with the prior-art devices for resetting to center. A freely selectable positioning of the coupling shaft via the pressing elements of the device for resetting to center is likewise not provided for in the prior-art devices.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
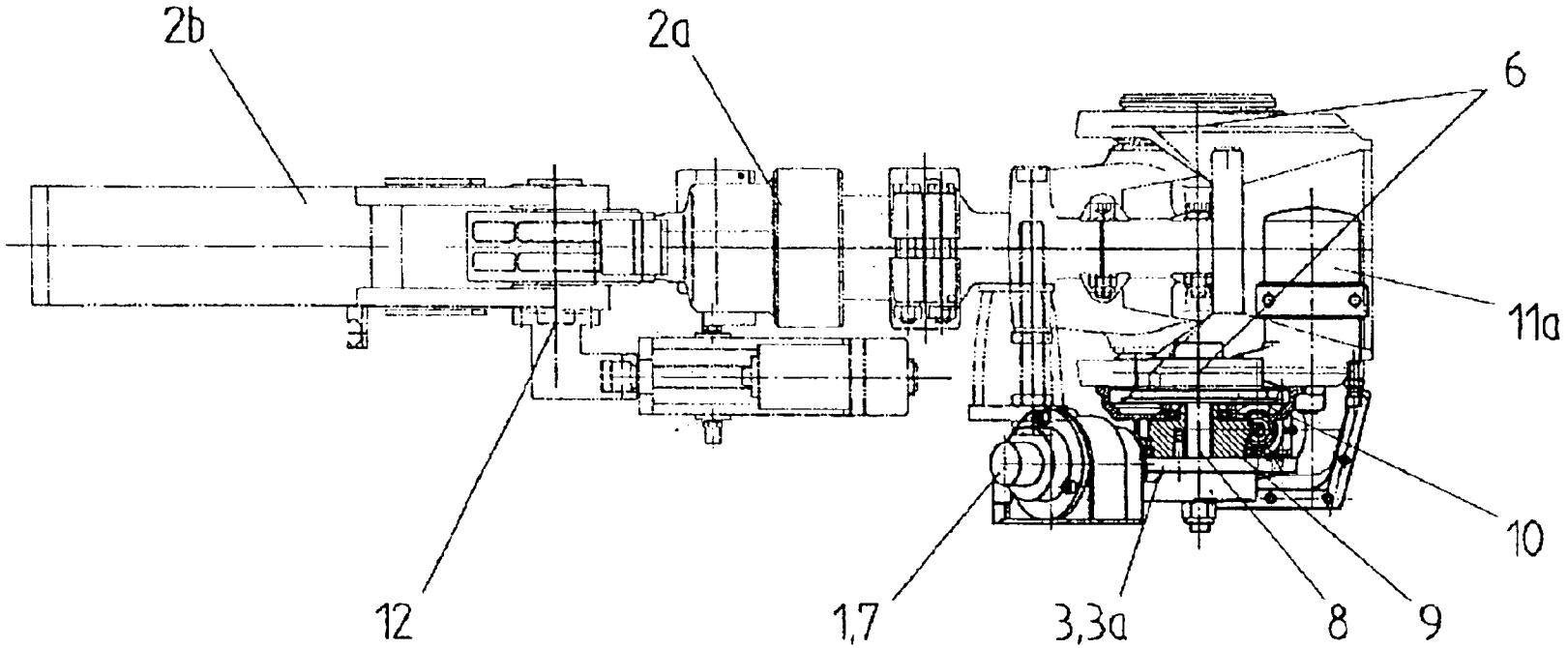
FIG. 1 is a partially cut-away side view of the device for resetting to center.
Figure 2:
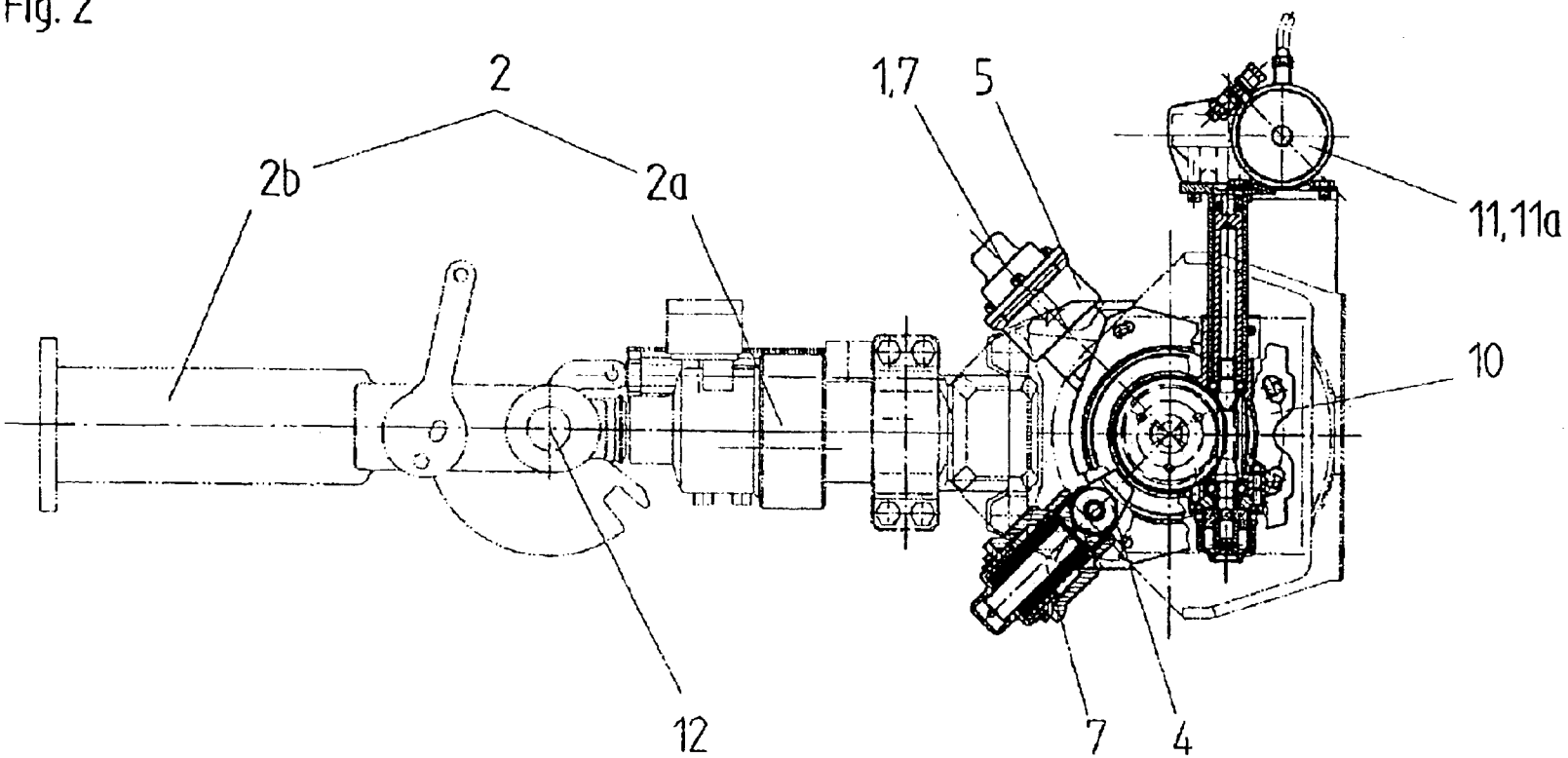
FIG. 2 is a top view of the device for resetting to center according to FIG. 1.

Referring to the drawings in particular, the device for resetting to center 1 for a central buffer coupling fastened pivotably by means of a coupling shaft 2 to a rail-borne vehicle has a guide 3, which follows the pivoting movement of the coupling shaft 2 around its vertical pivot axis. The device has pressing surfaces 4 arranged symmetrically to the longitudinal axis of the coupling shaft 2. The coupling shaft 2 is articulated to an articulated housing 5 by means of vertically directed bearing bolts 6 and is connected to the rail-borne vehicle via the housing. Pressing means 7, which bring about the horizontal resetting to center in cooperation with the pressing surfaces 4, are arranged in the articulated housing 5. A pressing means 7 is associated with each pressing surface 4. The guide 3 is designed in the exemplary embodiment as a cam 3*a*, which is mounted rotatably in the articulated housing 5 by means of vertically arranged bolts 8.

The cam 3*a* is coupled with the coupling shaft 2 in a synchronously rotating manner. The bolt 8 is arranged axially aligned with the bearing bolt 6 of the coupling shaft 2. The bolt 8 is functionally connected to the bearing bolt 6, and the cam 3*a* is rigidly connected to a gear 9, which is arranged under the cam 3*a* and is connected to and can be driven by an adjusting drive 11 via a gear mechanism 10, especially by means of an electric motor 11*a*.

The pressing means 7 is designed in the device 1 as a permanently acting pressing means or as a pressing means that switches off or can be switched off depending on the pivot angle or can be actuated by a pneumatically, hydraulically or electrically driven actuating means. The actuating means is designed in the exemplary embodiment as a remote-controllable adjusting drive 11. The guide 3 or the cam 3*a* and the coupling shaft 2, which is coupled therewith in a functionally connected manner, can be positioned in any position of the intended horizontal range of pivoting of the coupling shaft 2 in the flow of forces via the device 1 for resetting to center.

A means, not shown, which automatically switches off the adjusting drive 11 after reaching the lateral end position, can be arranged in the area of a lateral end position of the coupling shaft 2. Moreover, the pivoting back of the coupling shaft 2 after reaching the middle position can be designed as an operation that can be switched off automatically.

In the exemplary embodiment, the coupling shaft 2 is formed by a rear shaft part 2*a* and a front shaft part 2*b*, which are connected by means of a hinge 12 with vertical pivot axis, and the front shaft part 2*b* is designed such that it can be horizontally pivoted in relation to the rear shaft part 2*a*.

A second means, not shown, which initiates the pivoting operation of the front shaft part 2*b* in an automated manner via a second adjusting drive, is arranged in the area of the intended lateral end position of the coupling shaft 2.

Depending on the requirements and the intended degree of automation, it is possible to automate or make remote-controllable all or some of the pivoting operations, i.e., the pivoting of the stretched coupling shaft 2 from the middle position into a lateral end position of the range of pivoting and vice versa and/or the pivoting of the front shaft part 2*b*.

While specific embodiments of the invention have been shown and described in detail to illustrate the application of the principles of the invention, it will be understood that the invention may be embodied otherwise without departing from such principles.

APPENDIX

List of Reference Numbers

| | |
|---|---|
| 1 | Device for resetting to center |
| 2 | Coupling shaft |
| 2a | Rear shaft part |
| 2b | Front shaft part |
| 3 | Guide |
| 3a | Cam |
| 4 | Pressing surface |
| 5 | Articulated housing |
| 6 | Bearing bolt |
| 7 | Pressing means |
| 8 | Bolt |
| 9 | Gear |
| 10 | Gear mechanism |
| 11 | Adjusting drive |
| 11a | Electric motor |
| 12 | Hinge |

What is claimed is:

1. A device for horizontal resetting to center for a central buffer coupling arranged pivotably by means of a coupling shaft on a rail-borne vehicle, the device comprising:

a guide following the pivoting movement of the coupling shaft around a guide vertical pivot axis, the coupling shaft being in functional connection with said guide;

pressing surfaces provided symmetrically to a longitudinal axis of the coupling shaft;

pressing means with pressing parts supported onan articulated housing the coupling shaft, said pressing means for bringing about a horizontal resetting to center of the central buffer coupling, one of said pressing parts acting permanently or being switchable off depending on a pivot angle or being actuated by a pneumatically, hydraulically or electrically operated actuating means, associated with each pressing part, said actuating means including a remote-controllable adjusting drive for positioning said guide and the coupling shaft that is in functional connection therewith into any position of the intended horizontal range of pivoting of the coupling shaft, said guide being rigidly connected to a gear driven via a gear mechanism by said adjusting drive.

2. A device in accordance with claim 1, wherein a vertically arranged bolt is provided in said housing and the guide includes a cam mounted rotatably by means of said vertically arranged bolt, said guide being coupled with the coupling shaft in a synchronously rotating manner.

3. A device in accordance with claim 2, wherein the bolt is arranged axially aligned with a bearing bolt of the coupling shaft.

4. A device in accordance with claim 3, wherein the bolt is in functional connection with the bearing bolt.

5. A device in accordance with claim 2, wherein the cam is rigidly connected to said gear and said adjusting drive is an electric motor.

6. A device in accordance with claim 1, further comprising an automatic switch off means for switching off automatically after an end position is reached, said automatic switch off means is arranged in an area of a lateral end position of the coupling shaft or the central buffer coupling.

7. A device in accordance with claim 1, wherein the coupling shaft is formed by a rear shaft part and a front shaft part connected together by a hinge with a vertical pivot axis, wherein the front shaft part is horizontally pivotable in relation to the rear shaft part.

8. A device in accordance with claim 7, further comprising pivot initiation means for initiating the pivoting operation of the front shaft part, said pivot initiation means being arranged in the area of a lateral end position of the coupling shaft or of the central buffer coupling.

9. A device in accordance with claim 7, wherein the pivoting of the stretched coupling shaft from a middle position into a lateral end position and vice versa and/or the pivoting of the front shaft part are automated or remote-controllable.

10. A horizontal positioning rail-borne vehicle central buffer coupling connection arrangement comprising:

a coupling shaft;

a guide following the pivoting movement of the coupling shaft around a guide vertical pivot axis, said coupling shaft being in functional connection with said guide;

an actuating device;

pressing surfaces provided symmetrically to a longitudinal axis of the coupling shaft and pressing parts supported on an articulated housing for the coupling shaft, said pressing parts acting to horizontally reset to center the central buffer coupling, one of said pressing parts being switchable off depending on a pivot angle or being actuated by said actuating device, said actuating device including a remote-controllable adjusting drive for positioning said guide and the coupling shaft that is in functional connection therewith into any position of the intended horizontal range of pivoting of the coupling shaft;

a gear rigidly connected to said guide and driven via a gear mechanism by said adjusting drive.

11. A device in accordance with claim 10, further comprising a vertically arranged bolt provided in said housing, said guide including a cam mounted rotatably via said vertically arranged bolt, said guide being coupled with the coupling shaft in a synchronously rotating manner.

12. A device in accordance with claim 11, wherein said bolt is arranged axially aligned with a bearing bolt of said coupling shaft.

13. A device in accordance with claim 12, wherein the bolt is in functional connection with said bearing bolt.

14. A device in accordance with claim 11, wherein the cam is rigidly connected to said gear and said adjusting drive is an electric motor.

15. A device in accordance with claim 10, further comprising an automatic switch off device for an automatic switching off after an end position is reached, said automatic switch off device being arranged in an area of a lateral end position of said coupling shaft or the central buffer coupling.

16. A device in accordance with claim 10, wherein said coupling shaft is formed by a rear shaft part and a front shaft part connected together by a hinge with a vertical pivot axis, wherein the front shaft part is horizontally pivotable in relation to the rear shaft part.

17. A device in accordance with claim 6, further comprising pivot initiation means for initiating the pivoting operation of the front shaft part, said pivot initiation means being arranged in the area of a lateral end position of the coupling shaft or of the central buffer coupling.

18. A device in accordance with claim 16, wherein the pivoting of the stretched coupling shaft from a middle position into a lateral end position and vice versa and/or the pivoting of the front shaft part are automated or remote-controllable.

19. A vehicle buffer coupling connection arrangement comprising:

a housing:

a coupling shaft pivotally movable in said housing in a pivot range, said coupling shaft having a longitudinal axis;

pressing surfaces arranged symmetrically to said longitudinal axis of said coupling shaft;

pressing parts supported on said housing, said pressing parts cooperating with said pressing surfaces to selectively bias said coupling shaft to a center of said pivot range;

a gear mechanism and an adjusting drive connected to said housing and said coupling shaft for selectively positioning said coupling shaft into any position of said pivot range.

20. An arrangement in accordance with claim 19, wherein:

said gear drive is an electric motor.

* * * * *